US010410459B2

(12) United States Patent
Nishida et al.

(10) Patent No.: US 10,410,459 B2
(45) Date of Patent: Sep. 10, 2019

(54) PAPER SHEET HANDLING MACHINE AND PAPER SHEET HANDLING METHOD

(71) Applicant: FUJITSU FRONTECH LIMITED, Inagi (JP)

(72) Inventors: Mitsutaka Nishida, Inagi (JP); Hayato Minamishin, Inagi (JP); Naoto Ikeda, Inagi (JP)

(73) Assignee: FUJITSU FRONTECH LIMITED, Inagi (JP)

( * ) Notice: Subject to any disclaimer, the term of this patent is extended or adjusted under 35 U.S.C. 154(b) by 0 days.

(21) Appl. No.: 15/824,306

(22) Filed: Nov. 28, 2017

(65) Prior Publication Data

US 2018/0082510 A1 Mar. 22, 2018

Related U.S. Application Data

(63) Continuation of application No. PCT/JP2015/067346, filed on Jun. 16, 2015.

(51) Int. Cl.
*G07D 11/50* (2019.01)
*B65H 29/14* (2006.01)
(Continued)

(52) U.S. Cl.
CPC ..... *G07D 11/50* (2019.01); *B65H 3/0684* (2013.01); *B65H 3/5261* (2013.01);
(Continued)

(58) Field of Classification Search
CPC ..... G07D 11/0084; G07D 7/16; G07D 9/00; G07D 11/006; B65H 3/0684; B65H 29/62;
(Continued)

(56) References Cited

U.S. PATENT DOCUMENTS 6,351,551 B1 2/2002 Munro et al.
6,749,053 B2 * 6/2004 Ikuta ..... G07D 11/0012 109/66
(Continued)

FOREIGN PATENT DOCUMENTS

EP 2 077 535 A1 7/2009
JP 2000-251124 9/2000
(Continued)

OTHER PUBLICATIONS

Extended European Search Report dated Jun. 21, 2018 in corresponding European Patent Application No. 15895573.2, 9 pgs.
(Continued)

*Primary Examiner* — Patrick H Mackey
(74) *Attorney, Agent, or Firm* — Staas & Halsey LLP

(57) ABSTRACT

A banknote handling machine includes: a distinguishing unit that distinguishes a given classifying condition covering the type according to which banknotes from multiple types of banknotes that are put in are classified; a plurality of depositories in corresponding ones of which the banknotes whose type is distinguished by the distinguishing unit are classified and housed according to the classifying condition before a transaction relating to the put-in banknotes is determined; a plurality of housing units in corresponding ones of which the banknotes that are sent from the corresponding depositories are classified and housed according to the classifying condition after the transaction is determined; and a controller that controls the depositories according to the classifying condition.

11 Claims, 9 Drawing Sheets

(51) Int. Cl.

| | |
|---|---|
| ***B65H 31/24*** | (2006.01) |
| ***B65H 43/04*** | (2006.01) |
| ***B65H 43/08*** | (2006.01) |
| ***B65H 29/00*** | (2006.01) |
| ***B65H 29/62*** | (2006.01) |
| ***B65H 31/06*** | (2006.01) |
| ***B65H 31/10*** | (2006.01) |
| ***B65H 31/20*** | (2006.01) |
| ***B65H 31/22*** | (2006.01) |
| ***B65H 83/02*** | (2006.01) |
| ***B65H 3/06*** | (2006.01) |
| ***G07D 7/16*** | (2016.01) |
| ***B65H 3/52*** | (2006.01) |
| ***G07D 11/25*** | (2019.01) |
| ***G07D 11/14*** | (2019.01) |
| ***G07D 11/40*** | (2019.01) |
| ***G07D 11/18*** | (2019.01) |

(52) U.S. Cl.

CPC ..... *B65H 29/006* (2013.01); *B65H 29/14* (2013.01); *B65H 29/62* (2013.01); *B65H 31/06* (2013.01); *B65H 31/10* (2013.01); *B65H 31/20* (2013.01); *B65H 31/22* (2013.01); *B65H 31/24* (2013.01); *B65H 43/04* (2013.01); *B65H 43/08* (2013.01); *B65H 83/025* (2013.01); *G07D 7/16* (2013.01); *G07D 11/14* (2019.01); *G07D 11/18* (2019.01); *G07D 11/25* (2019.01); *G07D 11/40* (2019.01); *B65H 2301/4452* (2013.01); *B65H 2404/152* (2013.01); *B65H 2511/10* (2013.01); *B65H 2511/22* (2013.01); *B65H 2511/51* (2013.01); *B65H 2513/10* (2013.01); *B65H 2513/11* (2013.01); *B65H 2513/42* (2013.01); *B65H 2515/84* (2013.01); *B65H 2515/842* (2013.01); *B65H 2701/1912* (2013.01)

(58) Field of Classification Search

CPC ..... B65H 31/10; B65H 31/20; B65H 31/22; B65H 31/24; B65H 43/04; B65H 43/08; B65H 83/025; B65G 29/14; B65G 31/06

See application file for complete search history.

(56) References Cited

U.S. PATENT DOCUMENTS

| | | | | |
|---|---|---|---|---|
| 6,978,926 | B2 * | 12/2005 | Kobayashi | G07D 11/0054 235/379 |
| 7,249,707 | B2 * | 7/2007 | Yokoi | G07D 11/0012 235/379 |
| 7,950,512 | B2 * | 5/2011 | Folk | G07D 11/006 194/200 |
| 8,256,624 | B2 * | 9/2012 | Doi | G07D 11/0018 194/206 |
| 8,369,986 | B2 * | 2/2013 | Doi | B65H 39/115 270/58.18 |
| 2012/0261874 | A1 * | 10/2012 | Arikata | G07D 11/0081 271/9.01 |
| 2013/0313773 | A1 * | 11/2013 | Komatsu | G07D 11/40 271/265.01 |
| 2014/0185063 | A1 | 7/2014 | Osakabe et al. | |

FOREIGN PATENT DOCUMENTS

| | | |
|---|---|---|
| JP | 2005-99887 | 4/2005 |
| JP | 2005-227906 | 8/2005 |
| JP | 2015-95116 | 5/2015 |
| WO | WO 2011/135727 A1 | 11/2011 |
| WO | WO 2015/015588 A1 | 2/2015 |

OTHER PUBLICATIONS

International Search Report dated Aug. 11, 2015 in corresponding International Patent Application No. PCT/JP2015/067346.

Written Opinion of the International Searching Authority dated Aug. 11, 2015 in corresponding International Patent Application No. PCT/JP2015/067346.

* cited by examiner

PAPER SHEET HANDLING MACHINE AND PAPER SHEET HANDLING METHOD

CROSS-REFERENCE TO RELATED APPLICATION

This application is a continuation application of International Application PCT/JP2015/067346, filed on Jun. 16, 2015 and designating the U.S., the entire contents of which are incorporated herein by reference.

FIELD

The present invention relates to a paper sheet handling machine and a paper sheet handling method.

BACKGROUND

A banknote handling machine, such as an automated teller machine (ATM), includes a distinguishing unit that distinguishes, for example, the money type of inserted banknotes, a depository in which the inserted banknotes are temporarily housed before a depositing transaction is determined, and a plurality of housing units in which the banknotes sent from the depository are housed according to the money type after the depositing transaction is determined.

In addition to the above-described banknote handling machine intended for general users, there are banknote handling machines intended for institutional use by banknote handlers, such as banks. A banknote handling machine intended for institutional use does not make any depositing transaction relating to inserted banknotes and the inserted banknotes are directly sent to a corresponding plurality of housing units. For this reason, the banknote handling machine for institutional use does not include any depository in which banknotes before determination of a depositing transaction are temporarily stored. As for a housing unit that such a banknote handling machine for institutional use includes, a configuration including a temporal accumulation depository in which banknotes that are conveyed in are temporarily held is known.

Patent Literature 1: Japanese Laid-open Patent Publication No. 2000-251124

Patent Literature 2: Japanese Laid-open Patent Publication No. 2005-99887

International Publication Pamphlet No. WO 2011/135727

Normally, banknotes up to few tens of banknotes are deposited with a banknote handling machine intended for general users in most cases, meanwhile there is a demand that a large number of banknotes can be deposited collectively.

FIG. 9 is a schematic diagram illustrating a banknote handling machine of a technology related to the present application. As illustrated in FIG. 9, a banknote handling machine 101 intended for general users includes a banknote insertion unit 111, a distinguishing unit 112, a depository 113, a plurality of housing units 114, and a conveying unit 115. In the banknote handling machine 101, banknotes 106 in multiple money types are accumulated and housed in a mixed manner in the single depository 113. Different money types of the banknotes 106 may have different outer sizes, and thus there is a problem in that depositing the banknotes 106 of multiple money types in the depository 113 tends to cause paper jamming (hereinafter, jamming) of the banknotes 106 in the depository 113.

Multiple types of banknotes of various money types having relatively large differences in their outer size like those used in particularly, for example, Europe and China may be handled collectively. In this case, a housing space of the depository is set in accordance with banknotes having the largest outer size such that all types of banknotes can be housed in the single depository. When banknotes having relatively small outer sizes (hereinafter, referred to as small banknotes) are housed in such a depository, there is a problem in that the small banknotes are accumulated in various positions in the housing space and thus occurrence of jamming is caused.

The disclosed technology was made in view of the above-described circumstances and an object of the technology is to provide a paper sheet handling machine and a paper sheet handling method that enable housing multiple types of paper sheets in depositories properly.

SUMMARY

According to an aspect of the embodiments, a paper sheet handling machine includes: a distinguishing unit that distinguishes a given classifying condition covering the type according to which paper sheets from multiple types of paper sheets that are put in are classified; a plurality of depositories in corresponding ones of which the paper sheets whose type is distinguished by the distinguishing unit are classified and housed according to the classifying condition before a transaction relating to the put-in paper sheets is determined; a plurality of housing units in corresponding ones of which the paper sheets that are sent from the corresponding depositories are classified and housed according to the classifying condition after the transaction is determined; and a controller that controls the depositories according to the classifying condition.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Embodiments of the paper sheet handling machine and the paper sheet handling method disclosed herein will be described in detail with reference to the drawings. The Examples do not limit the paper sheet handling machine and the paper sheet handling method disclosed herein.

First Embodiment

Configuration of Banknote Handling Machine

Figure 1:
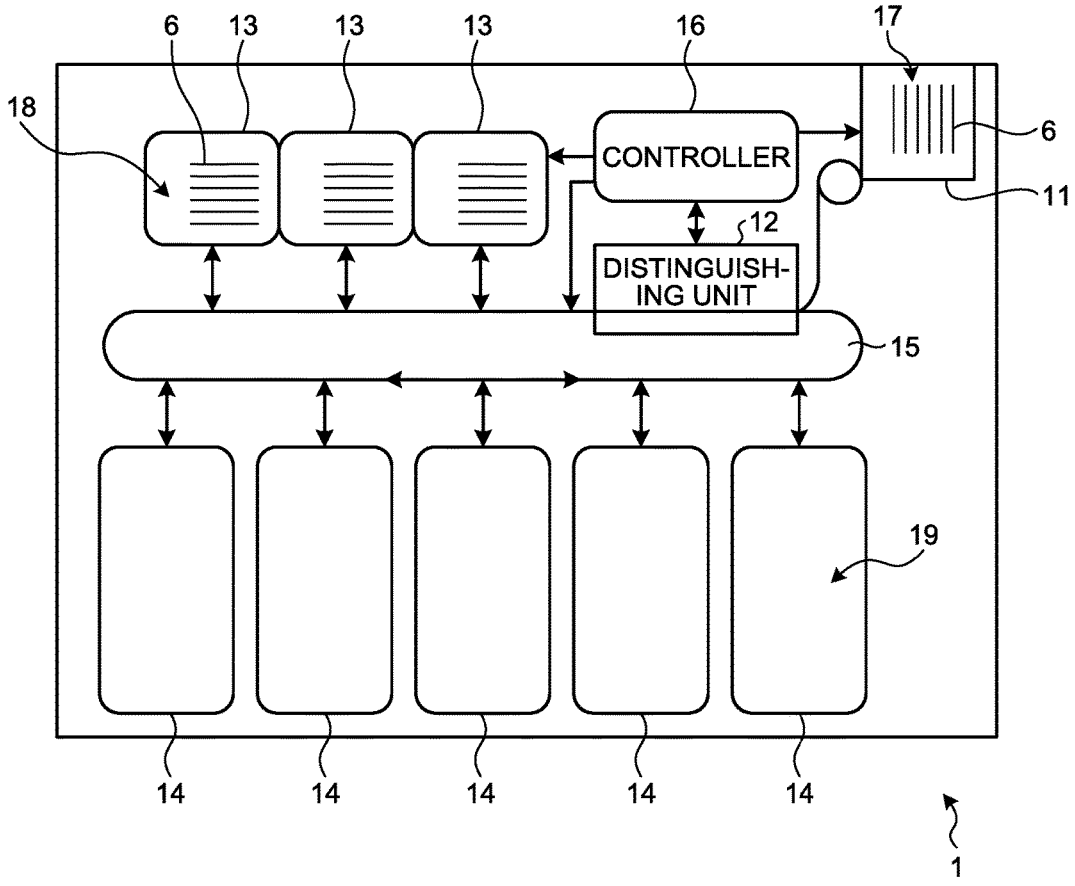
FIG. 1 is a schematic diagram illustrating a banknote handling machine of a first embodiment.

FIG. 1 is a schematic diagram illustrating a banknote handling machine of a first embodiment. As illustrated in FIG. 1, the banknote handling machine 1 of the first embodiment is intended for general users and includes a banknote insertion/withdrawal unit 11, a distinguishing unit 12, a plurality of depositories 13, a plurality of housing units 14, a conveying unit 15, and a controller 16. In the first embodiment, banknotes 6 are used as exemplary paper sheets; however, paper sheets are not limited to the banknotes 6.

A housing space 17, in which the banknotes 6 deposited or withdrawn by a user are housed, is provided in the banknote insertion/withdrawal unit 11. The banknote insertion/withdrawal unit 11 also functions as a returning unit from which the banknotes 6 are returned when a depositing transaction, which will be described below, is canceled. The returning unit may be provided independently of the banknote insertion/withdrawal unit 11.

The distinguishing unit 12 distinguishes a given classifying condition including the money type according to which the banknotes 6 that are inserted from the banknote insertion/withdrawal unit 11 are classified. The classifying condition includes, for example, the money type, damaged condition, and outer size. In the first embodiment, the money type is used as the classifying condition and the money type of the banknotes 6 is distinguished on the basis of the distinguishing data about the money type that is preset in the distinguishing unit 12. The banknote 6 whose money type is not distinguishable by the distinguishing unit 12, such as the banknote 6 with a partial deficit, is back from the distinguishing unit 12 to the banknote insertion/withdrawal unit 11 and then returned.

Before the depositing transaction relating to the inserted banknotes 6 is determined, the banknotes 6 whose money type is distinguished by the distinguishing unit 12, are classified, according to the money type that is the classifying condition and are housed in the corresponding depositories 13. Note that the depositories 13 are not limited to the configuration in which the banknotes 6 of only single type are housed in a single one of the depositories 13, and the banknotes 6 of multiple money types may be housed in the single depository 13 as appropriate.

The user approves that the value of the inserted banknotes 6 and the value of the banknotes 6 distinguished by the distinguishing unit 12 match and accordingly the depositing transaction is determined. When the user cancels the depositing transaction halfway, the banknotes 6 are back from the depositories 13 to the banknote insertion/withdrawal unit 11 and are returned.

Figure 2A:
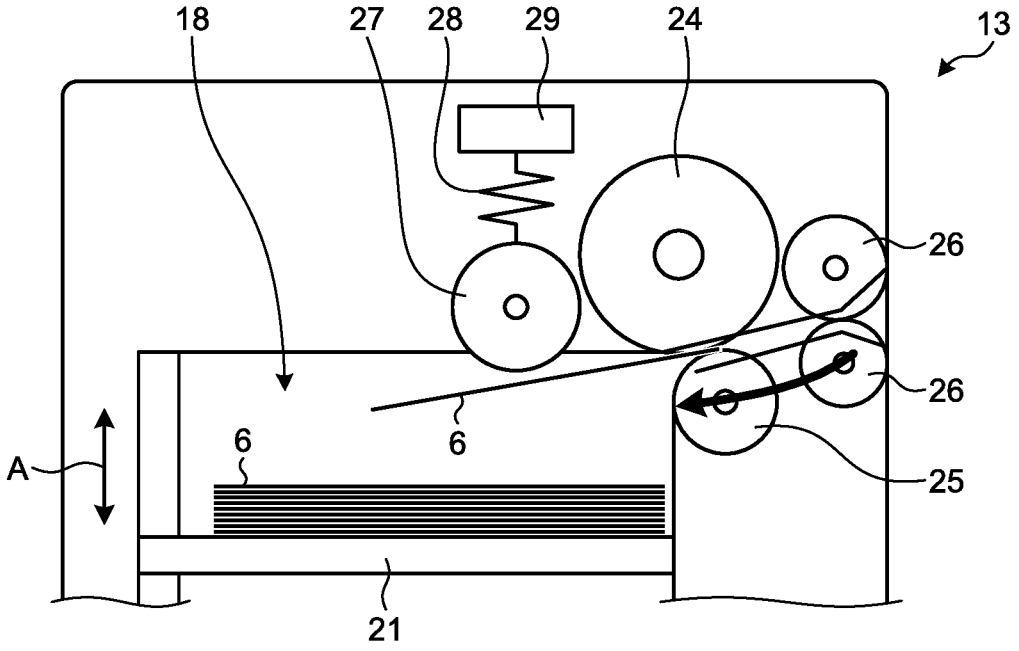
FIG. 2A is a schematic diagram illustrating a state where banknotes are held in a depository of the banknote handling machine of the first embodiment.
Figure 2B:
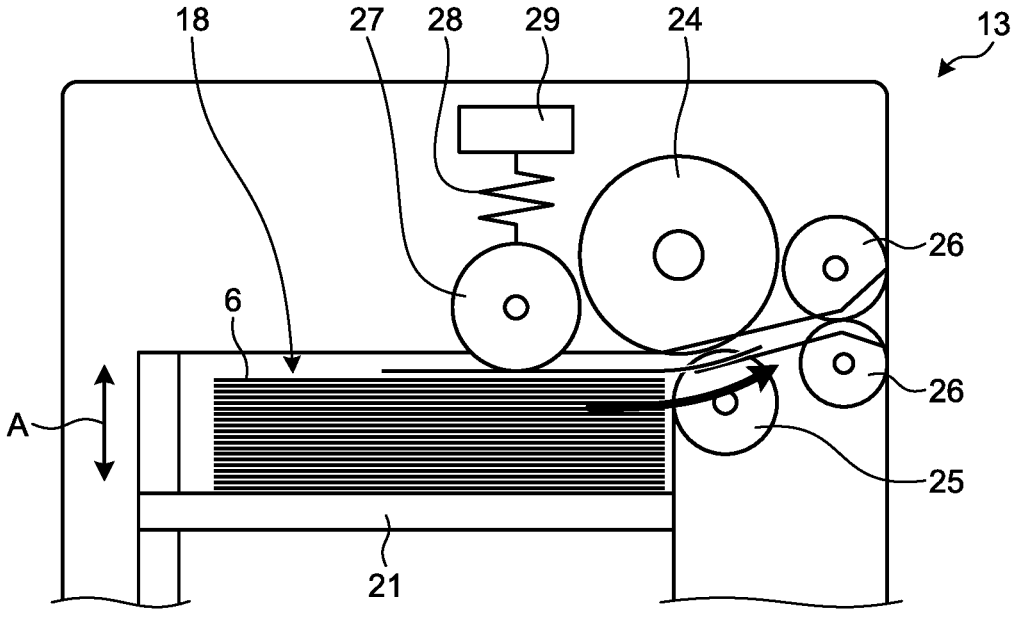
FIG. 2B is a schematic diagram illustrating a state where a banknote is flipped out from the depository of the banknote handling machine of the first embodiment.

FIG. 2A is a schematic diagram illustrating a state where the banknotes 6 are held in the depository 13 of the banknote handling machine 1 of the first embodiment. FIG. 2B is a schematic diagram illustrating a state where the banknote 6 is flipped out from the depository 13 of the banknote handling machine 1 of the first embodiment.

As illustrated in FIG. 2A, a housing space 18, in which the banknotes 6 are accumulated and housed, is provided in the depository 13. The housing space 18 of each of the depositories 13 is formed in a size suitable for the outer size of the banknotes 6 of the money type to be housed. A stage 21 on which the housed banknotes 6 are placed, is provided in the housing space 18 such that the stage 21 can lift up and down in the A direction represented in FIGS. 2A and 2B. The depository 13 includes, as a conveying mechanism that conveys the banknote 6, a pair a flipping-out roller 24 and a separation roller 25 and a pair of conveying rollers 26. The pair of the flipping-out roller 24 and the separation roller 25 and the pair of the conveying rollers 26 are arranged along a route in which the banknote 6 is conveyed to the housing space 18. The depository 13 further includes a pickup roller 27 serving as a conveying mechanism that pushes the banknotes 6 in the housing space 18, a power applying member 28 that applies power to the pickup roller 27, and a pressure sensor 29 that senses the pressure of the pickup roller 27.

As illustrated in FIG. 2A, the banknote 6 that is distinguished by the distinguishing unit 12, is conveyed to the pair of the conveying rollers 26 and is sent by the pair of the flipping-out roller 24 and the separation roller 25 into the housing space 18. The banknote 6 that is sent into the housing space 18, is accumulated and housed on the stage 21. The banknotes 6 that are accumulated on the stage 21, are pressed by the pickup roller 27 with a given pressure.

As illustrated in FIG. 2B, the banknote 6 that are housed in the housing space 18, are sent to the space between the pair of the flipping-out roller 24 and the separation roller 25 and are separated and flipped out one by one. The banknote 6 that is flipped out by the pair of the flipping-out roller 24 and the separation roller 25, is sent to the space between the pair of the conveying rollers 26 and is sent out by the pair of the conveying rollers 26 from the depository 13.

When the depositing transaction is determined, the banknotes 6 that are sent from the depositories 13, are classified and housed, according to the money type serving as the classifying condition in the corresponding housing units 14. For this reason, the housing units are arranged according to the money type according to which the banknotes 6 are classified. A housing space 19 in a size suitable for the outer size of the money type of the banknotes 6 to be housed, is provided in each of the housing units 14. The housing spaces are not limited to the configuration in which the banknotes 6 of only a single type are housed in the single housing unit 14. For example, multiple types of the banknotes 6 of various money types having small differences in their outer size, may be housed as appropriate.

Although not illustrated, the conveying unit 15 includes multiple rollers and a belt that forms a conveying route on which the banknote 6 is conveyed, and the conveying unit 15 is arranged to connect the banknote insertion/withdrawal unit 11, the distinguishing unit 12, and each of the depositories 13. In the first embodiment, part of the conveying route on which the banknote 6 is conveyed to the depository 13 from the distinguishing unit 12, also serves as part of the conveying route on which the banknote 6 is conveyed to the housing unit 14 via the distinguishing unit 12 from the depository 13. As described above, the conveying unit 15 is configured such that the banknote 6 is conveyable in both directions in which the banknote 6 is conveyed in and conveyed out of the depository 13. The conveying unit 15 is however not limited to the configuration enabling bidirectional conveying. A conveying route on which the banknote 6 is conveyed from the distinguishing unit 12 to the depository 13 and a conveying route on which the banknote 6 is conveyed from the depository 13 to the housing unit 14 via the distinguishing unit 12, may be provided independently. The conveying unit 15 includes a route switching mechanism (not illustrated) that switches the conveying route on which the banknote 6 is conveyed to the corresponding depository 13, and the route switching mechanism is controlled by the controller 16 according to the money type.

The controller 16 is connected electrically to the distinguishing unit 12, each of the depositories 13, each of the housing units 14 and the conveying unit 15. The controller 16 controls each of the conveying unit 15 and the depositories 13 according to the result of the distinguishing by the distinguishing unit 12, thereby classifying the banknotes 6 according to the money type and housing the banknotes 6 in the corresponding depositories 13, respectively. The conveying unit 15, the separation roller 25 and the pickup roller 27 of each of the depositories 13, are driven and controlled by the controller 16, and accordingly convey the banknote 6 at a conveying speed suitable for the outer size of the money type of the banknotes 6 to be housed in the corresponding depository 13. Furthermore, a passing sensor (not illustrated) that senses that the banknote 6 passes, may be provided in the conveying unit 15, and a configuration may be employed in which the controller 16 may control the conveying unit 15 and each of the depositories 13 according to the result of the sensing using the passing sensor.

In the first embodiment, the accumulation-type depositories 13 are used. Alternatively, a rollup-type depository (not illustrated) including a rollup drum around which the banknote 6 is rolled up together with a tape, may be used. When the rollup-type depository is used, the controller 16 controls the rollup speed of the rollup drum according to the classifying condition, thereby properly rolling up the banknote 6 according to the classifying condition.

Operation of Banknote Handling Machine

Figure 3:
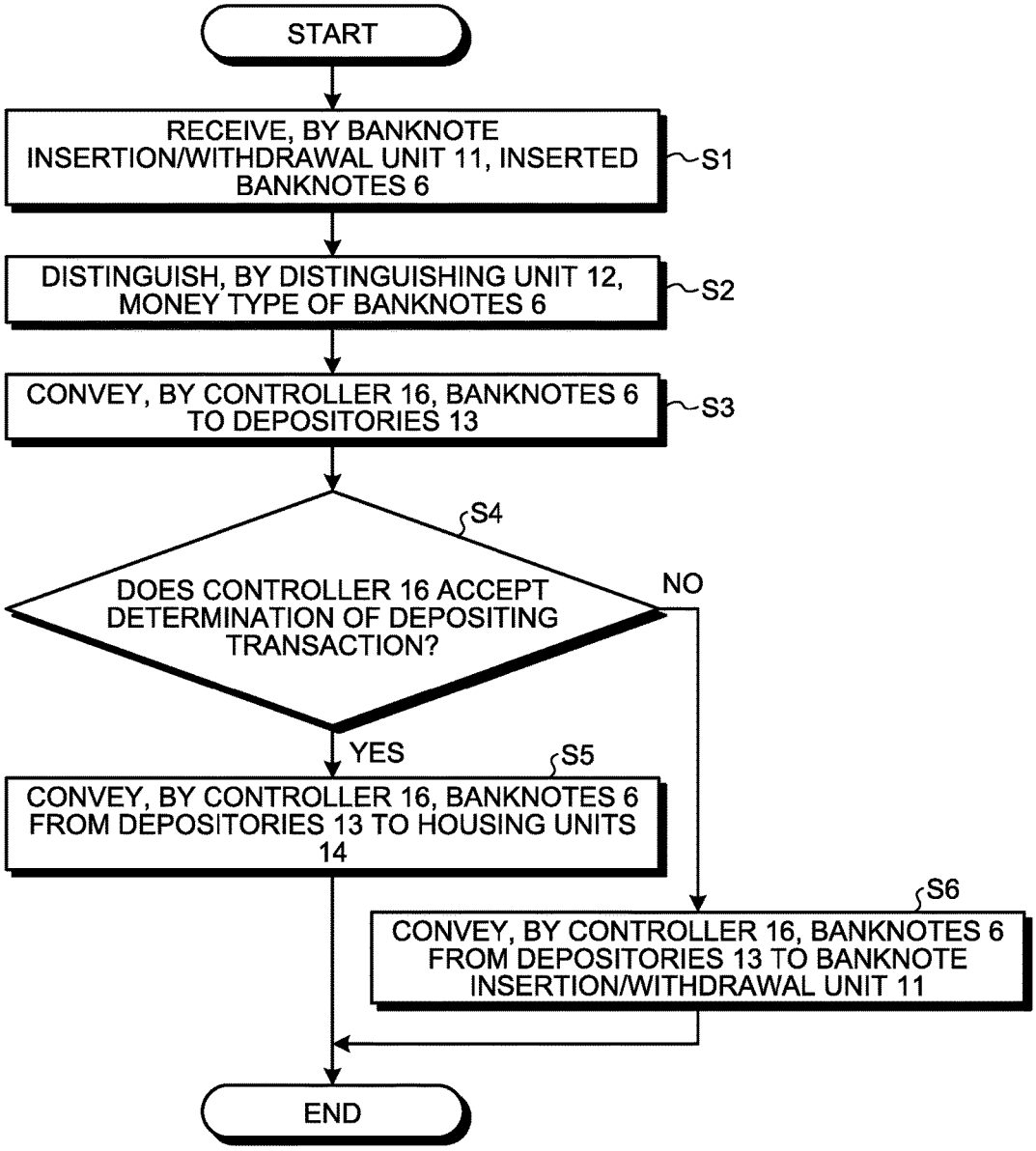
FIG. 3 is a flowchart for describing operations of the banknote handling machine of the first embodiment.

Operations of housing the banknotes 6 in the corresponding depositories 13 and the corresponding housing units 14 according to the classifying condition in the banknote handling machine 1 configured as described above will be described. FIG. 3 is a flowchart for describing operations of the banknote handling machine 1 of the first embodiment.

As illustrated in FIG. 3, the banknote insertion/withdrawal unit 11 receives the banknotes 6 inserted by the user (step S1). The controller 16 then sends the banknotes 6 inserted in the banknote insertion/withdrawal unit 11 to the distinguishing unit 12. The distinguishing unit 12 distinguishes the money type of the banknotes 6 (step S2). After the distinguishing unit 12 distinguishes the banknotes 6, the controller 16 controls the conveying unit 15 and each of the depositories 13 to convey the banknotes 6 to the corresponding depositories 13 according to the money type distinguished by the distinguishing unit 12 (step S3). At step S3, the controller 16 drives and controls the conveying unit 15, the separation roller 25, and the pickup roller 27 to convey the banknotes 6 at conveying speeds suitable for the outer sizes of the banknotes 6 of the money types to be housed in the corresponding depositories 13. Accordingly, before a depositing transaction is determined, the controller 16 classifies the banknotes 6 whose money type is distinguished by the distinguishing unit 12 according to the money type and houses the banknotes 6 in the corresponding depositories 13. As the banknotes 6 are classified, properly conveyed, and housed in the corresponding depositories 13, it is possible to reduce occurrence of jamming of the banknote 6 in each of the depositories 13.

The user approves that the value of the banknotes 6 inserted by the user and the value of the banknotes 6 distinguished by the distinguishing unit 12 match and accordingly the user determines the depositing transaction. The controller 16 determines whether the determination of the depositing transaction by the user is accepted (step S4). When the controller 16 accepts the determination of the depositing transaction, the controller 16 sends out the banknotes 6 housed in the corresponding depositories 13 from the depositories 13 to the distinguishing unit 12 and, after the banknotes 6 are distinguished by the distinguishing unit 12 again, the controller 16 conveys the banknotes 6 to the corresponding housing units 14 via the distinguishing unit 12 (step S5). As described above, after the depositing transaction is determined, the controller 16 classifies the banknotes 6 that are sent out from the corresponding depositories 13 according to the money type, and houses the banknotes 6 in the corresponding housing units 14. The controller 16 controls each of the depositories 13 and the conveying unit 15 according to the money type of the banknotes 6 distinguished by the distinguishing unit 12. As described above, the controller 16 drives and controls the conveying unit 15, the separation roller 25, and the pickup roller 27 to send out the banknotes 6 at conveying speeds suitable for the outer sizes of the banknotes 6 of the money types housed in the corresponding depositories 13. The controller 16 controls each of the housing units 14 such that the banknotes 6 are conveyed at conveying speeds suitable for the outer sizes of the banknotes 6 of the money types housed in the corresponding housing units 14.

On the other hand, when the controller 16 does not accept the depositing transaction at step S4, in other words, when the user does not determine and cancels the depositing transaction, the controller 16 performs control such that the banknotes 6 are conveyed from the corresponding depositories 13 to the banknote insertion/withdrawal unit 11, thereby returning the banknotes 6 (step S6). At step S6, the controller 16 controls each of the depositories 13, the banknote insertion/withdrawal unit 11, and the conveying unit 15 according to the money type of the banknotes 6.

The method of handling banknotes by using the banknote handling machine 1 of the first embodiment includes a first step, a second step, and a third step. The first step includes distinguishing the banknotes 6 from multiple types of the banknotes 6 that are inserted according to a given classifying conditions including the money type. The second step includes, before a depositing transaction relating to the inserted banknotes 6 is determined, classifying the banknotes 6 whose money type is distinguished at the first step according to the classifying condition, and housing the banknotes 6 in the corresponding depositories 13. The third step includes, after the depositing transaction is determined, sending the banknotes 6 from the depositories 13 to the corresponding housing units 14, and classifying and housing the banknotes 6 in the corresponding housing units 14 according to the classifying condition. The banknote handling method includes a step of determining whether the depositing transaction is determined between the second step and the third step. For example, it is determined that the depositing transaction is determined by the controller 16 when the user performs a depositing determination operation and the method moves to the third step.

The first embodiment includes the depositories 13 in which the banknotes 6 whose money type is distinguished by the distinguishing unit 12 are classified and housed according to the money type serving as the classifying condition and the controller 16 that controls the depositories 13 according to the money type. Accordingly, it is possible to properly house the banknotes 6 in the corresponding depositories 13 according to the money type, prevent occurrence of jamming of the banknotes 6 in the depositories 13, and increase the speed of processing on the banknotes 6.

In other words, providing the housing spaces 18 in sizes suitable for the outer sizes of the banknotes 6 of the money types to be housed in the corresponding depositories 13 enables prevention of occurrence of jamming in the depositories 13. Furthermore, the controller 16 controls each of the depositories 13 to convey the banknotes 6 at conveying speeds suitable for the outer sizes of the banknotes of the money types to be housed in the corresponding depositories 13 and thus it is possible to increase the speed of processing on the banknotes 6 over the banknote handling machine 1.

Furthermore, the banknote handling machine 1 includes the depositories 13 in which the banknotes 6 are classified and housed according to the money type and accordingly the entire volume of the housing spaces 18 in which the banknotes 6 can be housed increases substantially, which makes it possible to deal with the transaction of collectively depositing a large volume of the banknotes 6.

Another embodiment will be described with reference to the drawings. The same components as those of the first embodiment in another embodiment will be denoted with the same reference numerals as those of the first embodiment and descriptions thereof will be omitted.

Second Embodiment

Figure 4:
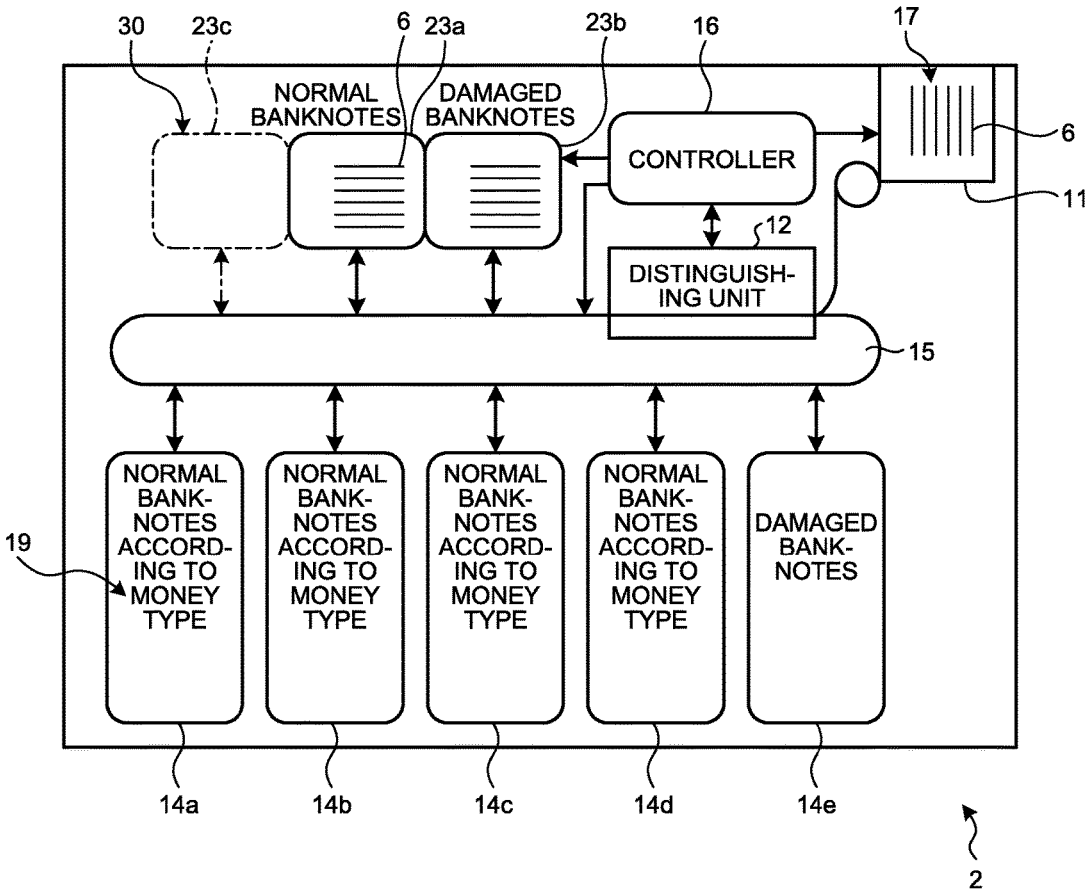
FIG. 4 is a schematic diagram illustrating a banknote handling machine of a second embodiment.

FIG. 4 is a schematic diagram illustrating a banknote handling machine of a second embodiment. the second embodiment is different from the first embodiment in that the banknotes 6 are classified and are housed in a plurality of depositories according to the damaged condition. As illustrated in FIG. 4, a banknote handling machine 2 of the second embodiment includes the banknote insertion/withdrawal unit 11, the distinguishing unit 12, a plurality of depositories 23, the housing units 14, the conveying unit 15, and the controller 16.

Before a depositing transaction relating to the banknotes 6 that are inserted is determined, the banknotes 6 whose money type is distinguished by the distinguishing unit 12 are classified and housed in the depositories 23 according to the damaged condition of the banknotes 6 serving as a classifying condition. For this reason, the distinguishing unit 12 distinguishes the damaged condition of the banknotes 6 in addition to the money type and the controller 16 classifies the banknotes 6 into normal banknotes and damaged banknotes according to the damaged condition, and houses the banknotes 6 in the corresponding depositories 23. The depositories 23 thus includes a depository 23*a* for normal banknotes in which normal banknotes are housed, and a depository 23*b* for damaged banknotes in which damaged banknotes are housed.

To house normal banknotes in the depository 23*a* for normal banknotes, the depository 23*a* for normal banknotes and the conveying unit 15 are controlled by the controller 16 to convey the normal banknotes at a conveying speed suitable for normal banknotes. In the same manner, to house damaged banknotes in the depository 23*b* for damaged banknotes, the depository 23*b* for damaged banknotes and the conveying unit 15 are controlled by the controller 16 to convey the damaged banknotes at a conveying speed suitable for damaged banknotes. For example, when damaged banknotes are conveyed, the conveying speed is set small and the interval in which each of the banknotes 6 is conveyed is set large compared to the case where normal banknotes are conveyed.

In the second embodiment, a normal banknote refers to the banknote 6 whose money type is distinguished by the distinguishing unit 12 and has no damage or the banknote 6 having little damage. In the second embodiment, a damaged banknote refers to the banknote 6 whose money type is distinguishable by the distinguishing unit 12 but whose damaged condition is significant. Abnormality of tear or of a shape with a partial loss or abnormality on the surface of a banknote resulting from attachment of dirt or a foreign matter or occurrence of ruck or folding is distinguished as the damaged condition of the banknotes 6. The distinguishing unit 12 distinguishes the damaged condition of the banknotes 6 between normal banknotes and damaged banknotes according to a given reference about the damaged condition. The banknotes 6 whose money type is not distinguishable by the distinguishing unit 12 are not housed in any of the depositories 23 after passing through the distinguishing unit 12, are sent to the banknote insertion/withdrawal unit 11 as the banknotes 6 unable to be handled, and then are returned.

The housing units 14 include housing units 14*a* to 14*d* for normal banknotes in which normal banknotes that are sent from the depository 23*a* for normal banknotes are classified and housed according to the money type, and a housing unit 14*e* for damaged banknotes in which damaged banknotes sent from the depository 23*b* for damaged banknotes are housed. The housing space 19 in a size suitable for the outer size of the banknotes 6 of the money type to be housed, is provided in each of the housing units 14*a* to 14*d* for normal banknotes. The housing unit 14*e* for damaged banknotes collectively houses the banknotes 6 of multiple money types that are sent from the depository 23*b* for damaged banknotes as damaged banknotes. For example, the banknotes 6 housed in the housing unit 14*e* for damaged banknotes are not reused as the banknotes 6 to be withdrawn to the user and are collected from the banknote handling machine 2. Each of the housing units 14*a* to 14*d* for normal banknotes and the housing unit 14*e* for damaged banknotes are controlled by the controller 16 to convey the banknote 6 at a conveying speed suitable for the banknote 6 to be housed according to the outer size of the banknote 6 to be housed and the classification between normal banknotes and damaged banknotes.

The banknote handling machine 2 includes a mount 30 on which another depository 23*c* for damaged banknotes is mounted as an additional depository. Adding the depository 23*c* for damaged banknotes as appropriate makes it possible to classify and house damaged banknotes. For example, with respect to the damaged condition of the banknotes 6, it is possible to classify the damaged banknotes into banknotes with significant dirt and banknotes with significant damage in their shape. To classify damaged banknotes in this manner, for example, the speed at which the damaged banknote whose shape is damaged, is conveyed, is set small and the interval at which each of the banknotes 6 is conveyed, is set large compared to the banknotes with dirt.

Furthermore, for example, it is preferable that the depository 23*a* for normal banknotes, the depository 23*b* for damaged banknotes, and the additional depository 23*c* for damaged banknotes be configured commonly. The common depositories 23*a* to 23*c* are properly controlled by the controller 16 to convey the banknotes 6 at conveying speeds suitable for the damaged condition of the banknotes 6 to be housed in the corresponding depositories 23*a* to 23*c*. Applying the common configuration to the depositories 23*a* to 23*c* as described above, reduces an increase in the costs of manufacturing the banknote handling machine 2.

In the banknote handling machine according to the technology related to the present application, normal banknotes and damaged banknotes are generally accumulated and housed in a mixed manner in the single depository. In order to prevent occurrence of jamming in the depository when normal banknotes and damaged banknotes are conveyed to and housed in the single depository, all the banknotes are conveyed according to the damaged condition of the banknotes that are damaged banknotes. As a result, the speed at which banknotes housed in the depository are conveyed is slow and this lowers the banknote processing speed.

On the other hand, the banknote handling machine 2 of the second embodiment includes the depository 23*a* for normal banknotes and the depository 23*b* for damaged banknotes in which multiple types of the banknotes 6 are classified into normal banknotes and damaged banknotes according to the damaged condition and are housed. Accordingly, it is possible to prevent jamming resulting from housing normal banknotes and damaged banknotes in a single depository and thus it is possible to classify the banknotes 6 according to the damaged condition and properly houses the banknotes 6 in the depositories 23*a* and 23*b*. Furthermore, the controller 16 is able to control the depositories 23*a* and 23*b* to convey the banknotes 6 at conveying speeds suitable for the damaged condition of the banknotes 6 to be housed in the depositories 23*a* and 23*b*. Accordingly, it is possible to set the speed at which a normal banknote is conveyed higher than the conveying speed at which a damaged banknote is conveyed, and thus it is possible to increase the speed of processing on the banknotes 6 over the banknote handling machine 2.

The second embodiment includes the depositories 23*a* and 23*b* in which the banknotes 6 are classified and housed according to the damaged condition and accordingly the entire volume of the housing space 18 in which the banknotes 6 can be housed increases substantially, which makes it possible to deal with the transaction of collectively depositing a large volume of the banknotes 6.

According to the banknote handling machine 2, it is possible to mount the additional depository 23*c* to the mount 30 as appropriate. For this reason, it is possible to classify the banknotes 6 according to the damaged condition more finely, and thus it is possible to house the banknotes 6 in the corresponding depositories 23*a*, 23*b* and 23*c* more properly.

In the second embodiment, the banknotes 6 are classified into normal banknotes and damaged banknotes and are housed in the depositories 23*a* and 23*b*. Alternatively, for example, a configuration may be employed in which the banknotes 6 are classified into counterfeit or copied fraudulent banknotes and normal banknotes and then are housed in the depositories. In this configuration, a configuration may be employed in which, when a fraudulent banknote is housed in a depository, the controller 16 notifies the security of the fraudulent banknote.

Third Embodiment

Figure 5:
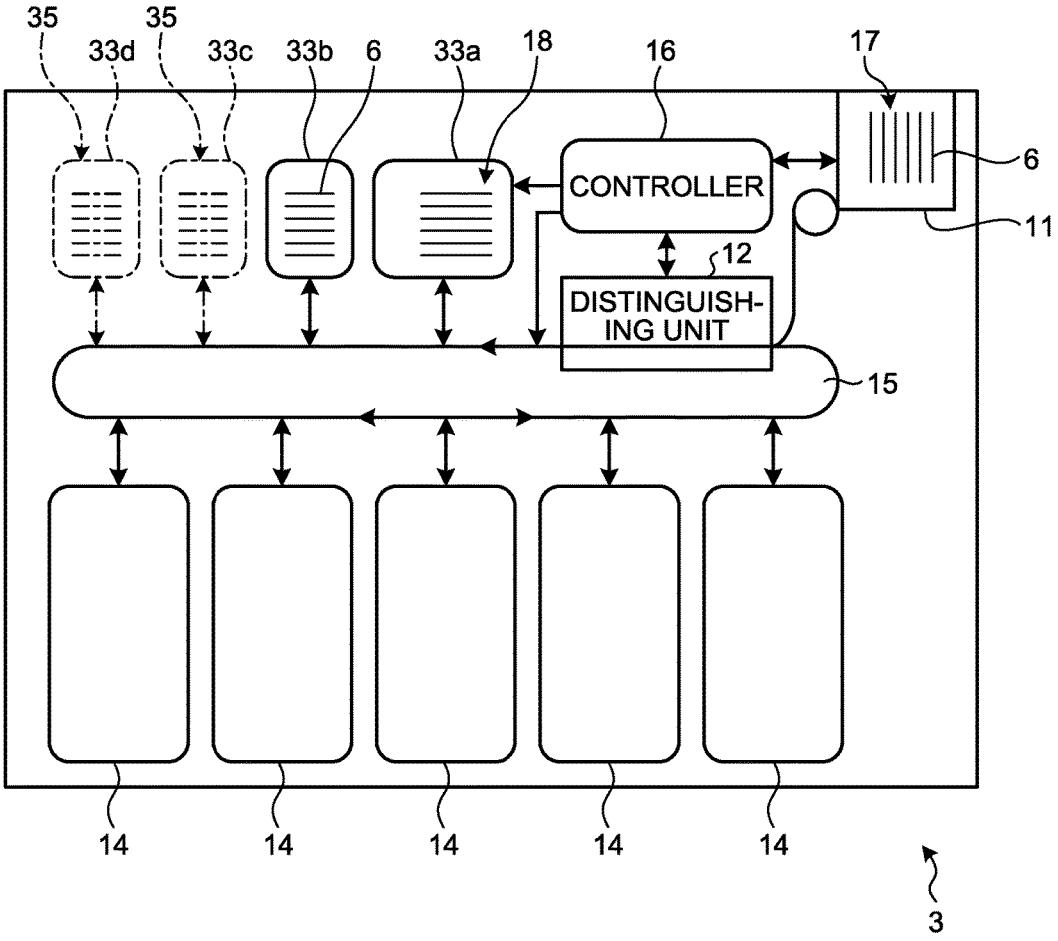
FIG. 5 is a schematic diagram illustrating a banknote handling machine of a third embodiment.

FIG. 5 is a schematic diagram illustrating a banknote handling machine of a third embodiment. As illustrated in FIG. 5, a banknote handling machine 3 of the third embodiment includes the banknote insertion/withdrawal unit 11, the distinguishing unit 12, a plurality of depositories 33, the multiple housing units 14, the conveying unit 15, and the controller 16.

In the third embodiment, the banknotes 6 are classified and housed in the depositories 33 according to their outer size. In the first embodiment, the banknotes 6 are classified and housed in the corresponding depositories 13 according to the money type and substantially classifies the banknotes 6 according to their outer size. the first embodiment is applied to handling the banknotes 6 having relatively small differences in their outer size according to each money type, such as the banknotes 6 used in Japan. On the other hand, the third embodiment is similar to the first embodiment in that the banknotes 6 are classified according to their outer size but is different from the first embodiment in that the third embodiment is intended for handling the banknotes 6 particularly having relatively large differences in their outer size according to each money type, such as the banknotes 6 used in Europe and China.

The distinguishing unit 12 in the third embodiment may distinguish the outer size of the banknotes 6 by using the size data that is preset according to each money type of the banknotes 6 and may distinguish the outer size of the banknotes 6 on the basis of intervals (the time of passing) at which the banknotes 6 pass through the passing sensor (not illustrated). The controller 16 controls each of the conveying unit 15 and the depositories 33 according to the outer size of the banknote 6 that is distinguished by the distinguishing unit 12.

Before a depositing transaction relating to the banknotes 6 that are inserted is determined, the banknotes 6 whose money type is distinguished by the distinguishing unit 12 are classified and housed according to the outer size serving as a classifying condition. The outer sizes of the banknotes 6 are classified into two types by comparing a given threshold about the length of the longer side and the length of the longer side that is distinguished. The depositories 33 include a depository 33*a* for large banknotes in which multiple types of the banknotes 6 whose outer size is relatively large (hereinafter, referred to as large banknotes) and a depository 33*b* for the banknotes 6 whose outer size is relatively small (small banknotes).

The housing spaces 18 in sizes suitable for the outer sizes of the multiple types of the banknotes 6 to be housed, are provided in the respective depositories 33*a* and 33*b*. Accordingly, the housing spaces 18 of the respective depositories 33*a* and 33*b* have different sizes. Multiple types of the banknotes 6 having a small difference in their outer size according to each money type are stored in each of the depositories 33*a* and 33*b*.

The banknote handling machine 3 further includes a plurality of mounts 35 on which additional depositories 33*c* and 33*d* for housing the banknotes 6 whose outer sizes are different from the outer sizes of the banknotes 6 to be housed in the corresponding depositories 33*a* and 33*b* are mounted. For this reason, adding the additional depository 33*c* to the mount 35 as appropriate makes it possible to increase the number of the depositories 33. Accordingly, it is possible to reduce the number of money types of the banknotes 6 to be collectively housed in the single depository 33 and thus further finely classifies the banknotes 6 according to the outer size.

Although it is not illustrated, a space regulating wall that regulates the housing space 18 may be movably provided in each of the depositories 33*a* and 33*b* and the additional depository 33*c* or a configuration may be employed in which the housing space 18 is variable to a size suitable for the outer size of the banknotes 6 according to the position of the space regulating wall. This configuration enables a common configuration among the depositories 33*a* and 33*b* and the additional depository 33*c*, which inhibits an increase in the cost of manufacturing the banknote handling machine 3.

Figure 6A:
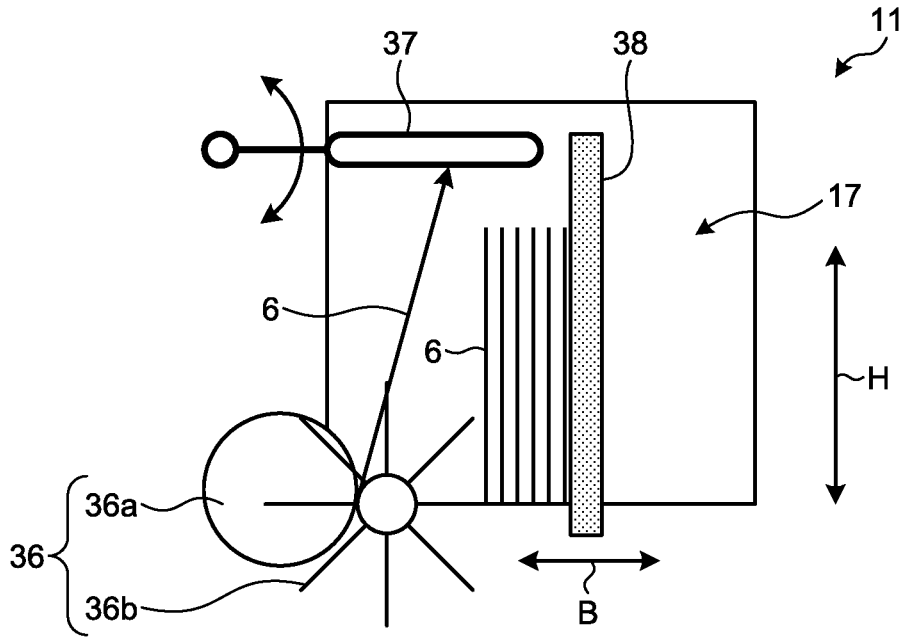
FIG. 6A is a cross-sectional view schematically illustrating a state where banknotes are returned from the depository of the banknote handling machine of a third embodiment to the banknote insertion/withdrawal unit.
Figure 6B:
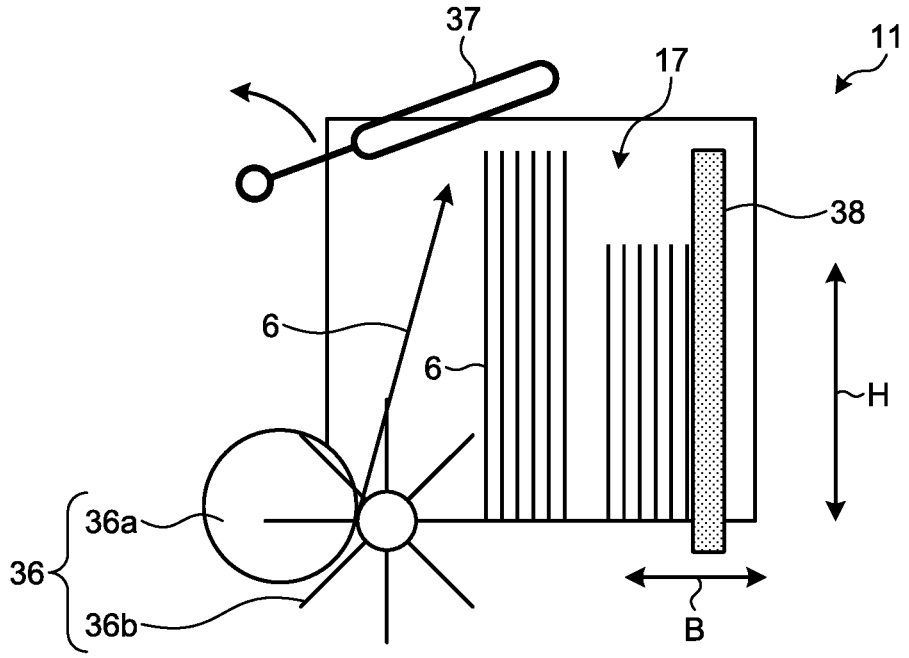
FIG. 6B is a cross-sectional view schematically illustrating a state where banknotes of another type are returned from the depository of the banknote handling machine of the third embodiment to the banknote insertion/withdrawal unit.

FIG. 6A is a cross-sectional view schematically illustrating a state where the banknotes 6 are returned from the depository 33*a* of the banknote handling machine 3 of the third embodiment to the banknote insertion/withdrawal unit 11. FIG. 6B is a cross-sectional view schematically illustrating a state where the banknote 6 of another type of is returned from the depositories 33*a* or 33*b* of the banknote handling machine 3 of the third embodiment to the banknote insertion/withdrawal unit 11.

As illustrated in FIG. 6A, the banknote insertion/withdrawal unit 11 also serving as a returning unit includes a conveying mechanism 36, a space regulating lever 37 serving as a space regulating member that regulates the housing space 17, and a stage 38 on which the banknotes 6 are accumulated. The conveying mechanism 36 includes the conveying roller 36*a* and an impeller 36*b*. The stage 38 is provided in the housing space 17 movably along the B direction represented in FIGS. 6A and 6B. The space regulating lever 37 has one end that is supported pivotably and the space regulating lever 37 is driven and controlled by the controller 16. The space regulating lever 37 pivots with respect to the housing space 17 and thus regulates the size of the housing space 17 in the H direction represented in FIGS. 6A and 6B. Accordingly, it is possible to properly accumulate the banknotes 6 having a desired outer size along the stage 38.

First of all, small banknotes that are the banknotes 6 whose outer size is relatively small, are sent from the depository 33*b* for small banknotes to the banknote insertion/withdrawal unit 11 configured as described above. The controller 16 causes the space regulating lever 37 to pivot in the housing space 17 and accordingly the small banknotes are properly accumulated on the stage 38 in the housing space 17. As illustrated in FIG. 6B, the large banknotes that are the banknotes 6 whose outer size is relatively large, are sent from the depository 33*a* for large banknotes to the banknote insertion/withdrawal unit 11. The controller 16 causes the space regulating lever 37 to pivot in a direction in which the space regulating lever 37 separates from the housing space 17 and thus the large banknotes are properly accumulated on the stage 38 in the housing space 17.

As described above, the controller 16 causes the space regulating lever 37 to pivot according to the outer size of the banknotes 6 that are sent from the corresponding depository 33*a* or 33*b* and thus small banknotes and large banknotes housed in the housing space 17 of the banknote insertion/withdrawal unit 11, are returned in a state of being properly accumulated. The banknotes 6 are sent sequentially from ones whose outer size is small from the depositories 33*a* and 33*b* to the banknote insertion/withdrawal unit 11 and thus it is possible to properly accumulate small banknotes and large banknotes by using a simple configuration in which the space regulating lever 37 is caused to pivot with respect to the housing space 17. Accordingly, multiple types of the banknotes 6 sent from the corresponding depositories 33*a* and 33*b*, are stably housed in the banknote insertion/withdrawal unit 11 and thus it is possible to inhibit occurrence of jamming in the banknote insertion/withdrawal unit 11 when the banknotes 6 are returned.

In the third embodiment, the space regulating lever 37, which is provided pivotally in the housing space 17 is used in order to regulate the size of the housing space 17 in the banknote insertion/withdrawal unit 11; however, the embodiments are not limited to this configuration. Although not illustrated in the drawings, for example, a space regulating wall that regulates the housing space 17 may be movably provided.

Figure 7:
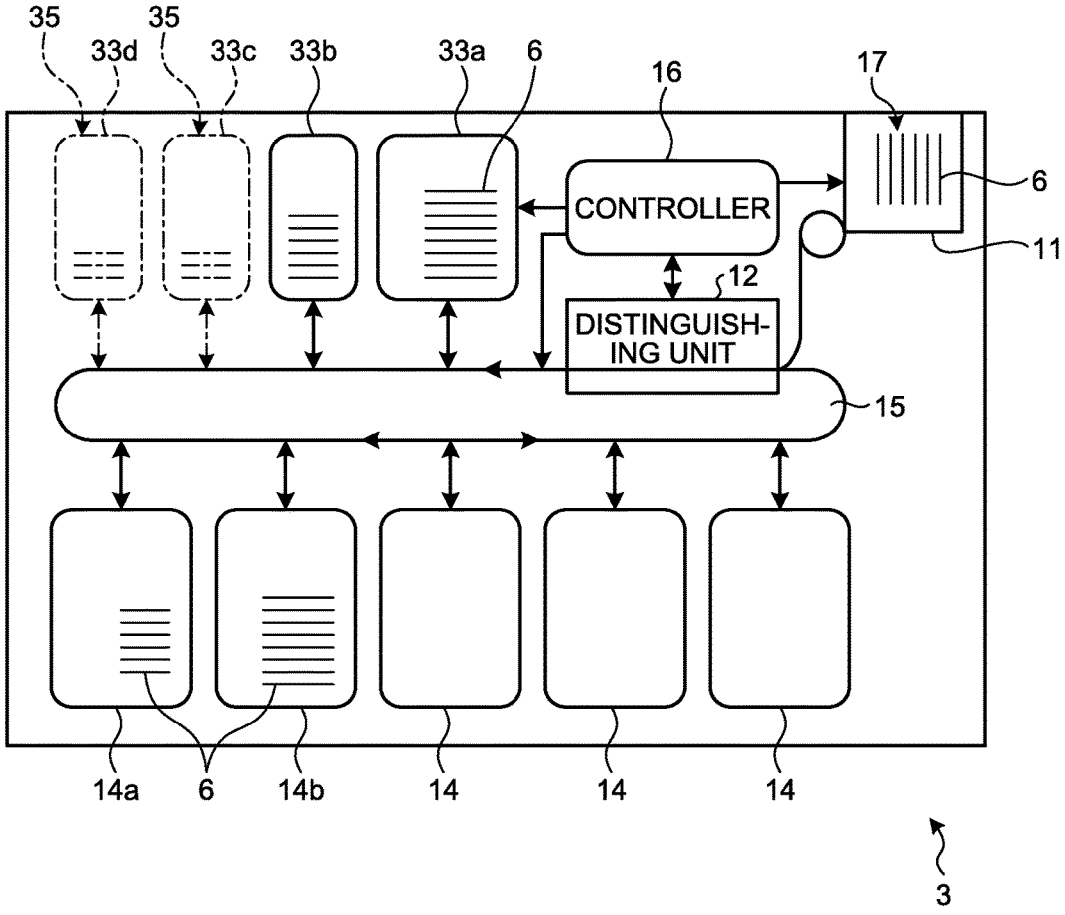
FIG. 7 is a schematic diagram for describing operations of scrutiny of banknotes housed in corresponding housing units in the banknote handling machine of the third embodiment.

The operations of performing scrutiny, in which the number of the banknotes 6 housed in each of the housing units 14 is recounted in the banknote handling machine 3 of the third embodiment, will be described. FIG. 7 is a schematic diagram for describing operations of performing scrutiny of the banknotes 6 housed in the corresponding housing units 14 in the banknote handling machine 3 of the third embodiment. The banknotes 6 are classified and housed according to the money type in the corresponding housing units 14. For this reason, as illustrated in FIG. 7, for example, the banknotes 6 whose outer size is small compared to that of the banknotes 6 housed in the housing unit 14*b*, are housed in the housing unit 14*a*. The controller 16 controls the conveying unit 15 and each of the depositories 33*a* and 33*b* and thus the banknotes 6 sent out of the housing unit 14*a* are sent to and housed in the depository 33*b* for small banknotes suitable for the outer size. The controller 16 controls the conveying unit 15 and each of the depositories 33*a* and 33*b* and thus the banknotes 6 sent out of the housing unit 14*b* are sent to and housed in the depository 33*a* for large banknotes suitable for the outer size.

The banknotes 6 sent out of the corresponding housing units 14 are classified and housed in the corresponding depositories 33*a* and 33*b* according to their outer size. The banknotes 6 housed in the corresponding depositories 33*a* and 33*b* are sent to the distinguishing unit 12 and the distinguishing unit 12 distinguishes the money type and counts the number of the banknotes 6. The banknotes 6 sent from the distinguishing unit 12 are classified and housed according to their money type in the corresponding housing units 14. In the third embodiment, the banknotes 6 housed in the corresponding housing units 14 are housed in the corresponding depositories 33*a* and 33*b* suitable for the outer size and therefore occurrence of jamming in each of the depositories 33*a* and 33*b* is inhibited and scrutiny is performed stably.

The banknote handling machine 3 of the third embodiment includes the depository 33*a* for large banknotes and the depository 33*b* for small banknotes in which multiple types of the banknotes 6 are classified and housed according to their outer size. Accordingly, it is possible to prevent jamming resulting from housing multiple types of the banknotes 6 having different outer sizes in a single depository, and thus it is possible to classify the banknotes 6 according to the outer size and houses the banknotes 6 in the corresponding depositories 33*a* and 33*b* properly. Furthermore, the controller 16 is able to control each of the depositories 33*a* and 33*b* to convey the banknotes 6 at conveying speeds suitable for the outer sizes of the banknotes 6 to be housed in the corresponding depositories 33*a* and 33*b*. It is thus possible to convey large banknotes and small banknotes at conveying speeds respectively suitable for large banknotes and small banknotes and thus increase the speed of processing on the banknotes 6 over the banknote handling machine 3.

In the banknote handling machine of the technology related to the present application, even when multiple types of banknotes having different outer sizes are housed in a single depository properly, the multiple types of banknotes are returned to the returning unit from the depository when the depositing transaction is canceled. For this reason, when the multiple types of banknotes are returned from the depository to the returning unit, the positions of small banknotes accumulated in the returning unit tend to vary and there is a risk that jamming occur in the returning unit.

On the other hand, in the third embodiment, the controller 16 causes the space regulating lever 37 to pivot according to the outer size of the banknotes 6 to be returned to the banknote insertion/withdrawal unit 11 also serving as the returning unit, which makes it possible to properly accumulate small banknotes and large banknotes in the banknote insertion/withdrawal unit 11. Furthermore, returning the banknotes sequentially from those having relatively small outer size to the banknote insertion/withdrawal unit 11 enables proper accumulation of small banknotes and large banknotes by using a simple configuration in which the space regulating lever 37 is caused to pivot. Accordingly, the multiple types of the banknotes 6 are stably housed in the banknote insertion/withdrawal unit 11, and thus it is possible to prevent occurrence of jamming when the banknotes 6 are returned.

When scrutiny of the banknotes 6 housed in the housing units 14 is performed, the banknotes 6 are sent out of the housing units 14 and conveyed to the depositories 13 and the distinguishing unit 12 sequentially and then are housed in the housing units 14 gain. When such scrutiny is performed, in the banknote handling machine of the technology related to the present application, multiple types of banknotes are housed in a single depository, and thus the positions of small banknotes accumulated in the housing space of the depository tend to vary, and therefore there is a risk that jamming occurs in the depository.

On the other hand, the banknote handling machine 3 of the third embodiment makes it possible to, when scrutiny is performed, classify and house, in the corresponding depositories 33*a* and 33*b*, the banknotes 6 housed in the corresponding housing units 14 according to their outer size. For this reason, when scrutiny is performed, as in the case where the banknotes 6 are held before a depositing transaction is determined, it is possible to prevent jamming resulting from housing the banknotes 6 housed in the corresponding housing units 14 in the single depository and stably perform scrutiny.

The third embodiment includes the multiple depositories 33*a* and 33*b* in which the banknotes 6 are classified and housed according to their outer size and accordingly the entire capacity of the housing spaces 18, in which the banknotes 6 can be housed, increases substantially, which makes it possible to deal with the transaction of collectively depositing a large volume of the banknotes 6.

Also in the banknote handling machine 3 of the third embodiment, it is possible to mount the additional depositories 33*c* and 33*d* to the mount 35 as appropriate. For this reason, it is possible to classify the banknotes 6 according to their outer size more finely, and thus it is possible to house the banknotes 6 in the corresponding depositories 33*a* to 33*d* more properly.

Fourth Embodiment

Figure 8:
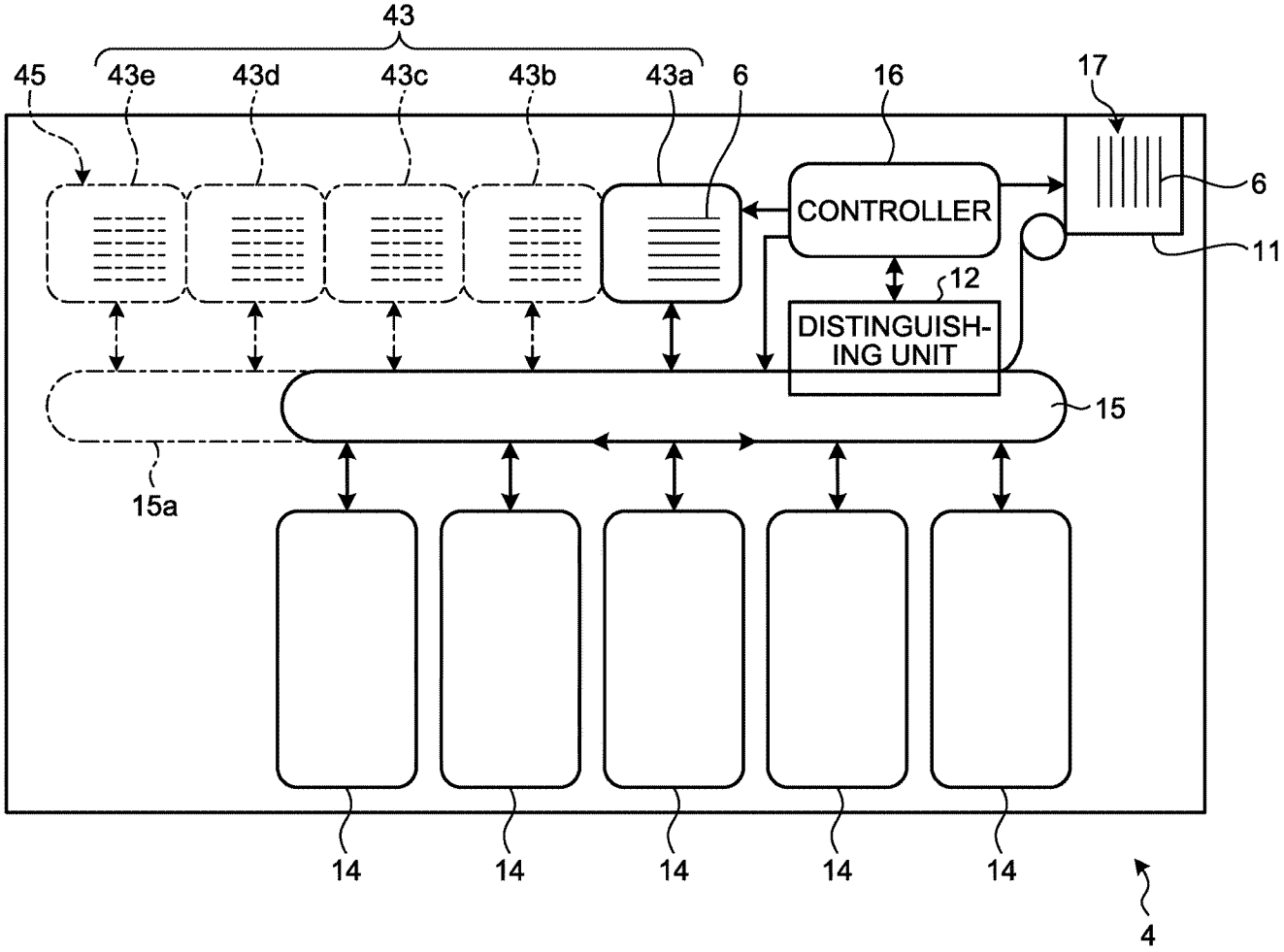
FIG. 8 is a schematic diagram illustrating a banknote handling machine of a fourth embodiment.
Figure 9:
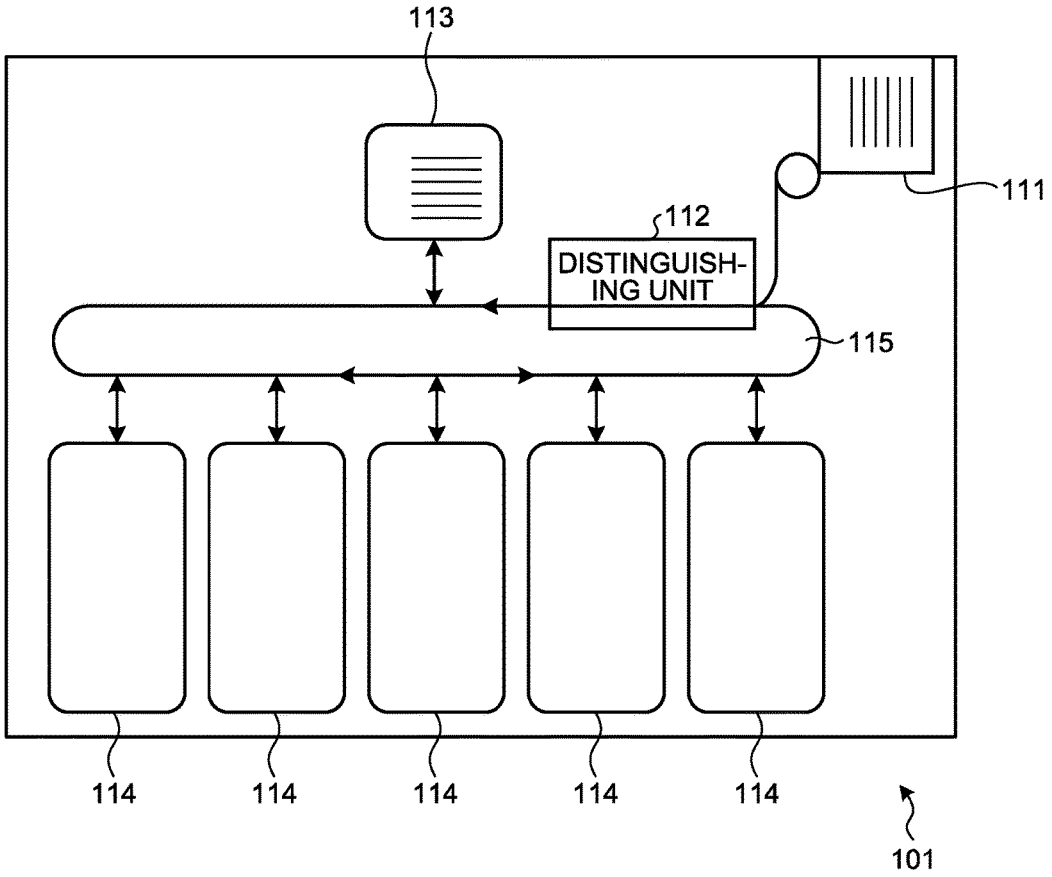
FIG. 9 is a schematic diagram illustrating a banknote handling machine of a technology related to the present application.

FIG. 8 is a schematic diagram illustrating a banknote handling machine according to a fourth embodiment. The fourth embodiment includes only one depository and is different from the first embodiment in that mounting an additional depository as appropriate enables the same configuration as that of the first to the third embodiments. As illustrated in FIG. 8, a banknote handling machine 4 of the fourth embodiment includes the banknote insertion/withdrawal unit 11, the distinguishing unit 12, a depository 43*a*, a plurality of mounts 45 on which additional depositories 43*b* to 43*e* are mounted, the housing units 14, the conveying unit 15, and the controller 16.

In the banknote handling machine 4 of the fourth embodiment, it is possible to use the depository 43*a* (43) and the additional depositories 43*b* to 43*e* (43) in combination by mounting the needed number of the depositories 43*b* to 43*e* on the mounts 45. For this reason, the fourth embodiment enables classifying and housing the banknotes according to the given classifying condition in the multiple depositories 43*a* to 43*e*, and is able to function as any one of the first to the third embodiments.

The mount 45 may include a mounting sensor that senses mounting the additional depositories 43*b* to 43*e* and a configuration may be employed in which the controller 16 automatically recognizes the number of the additional depositories 43*b* to 43*e* that are mounted on the mounts 45 by using the mounting sensor. A configuration may be employed in which, when the additional depositories 43*b* to 43*e* are mounted on the mounts 45, manual setting enables the controller 16 to recognize the number of the additional depositories 43*b* to 43*e*.

The conveying unit 15 of the fourth embodiment includes a conveying space 15*a* in which the conveying route is extensible to the additional depositories 43*b* to 43*e* as appropriate. The conveying unit 15 may be configured to include in advance, instead of including the conveying space 15*a*, a conveying route on which the banknotes 6 are conveyable to the additional depositories 43*b* to 43*e*.

According to the fourth embodiment, for example, when enabling handling that makes it possible to collectively deposit a large number of the banknotes 6 is needed, it is possible to ensure extendability enabling easily adding the additional depositories 43*b* to 43*e* as appropriate. The fourth embodiment includes the depositories 43*a* to 43*e* in which the banknotes 6 are classified and housed according to the given classifying condition and this substantially increases the entire capacity of the housing spaces 18 in which the banknotes 6 can be housed, which enables handling of collectively depositing a large volume of the banknotes 6. The conveying unit 15 of the fourth embodiment includes the conveying space 15*a* in which the conveying route is extendable, which makes it possible to easily deal with the additional depositories 43*b* to 43*e*.

In the banknote handling machine 4 of the fourth embodiment, mounting the additional depositories 43*b* to 43*e* on the mounts 45 makes it possible to classify and house multiple types of the banknotes 6 according to the given classifying condition in the corresponding depositories 43*a* to 43*e*. Accordingly, it is possible to prevent jamming resulting from housing multiple types of the banknotes 6 in a single depository and thus properly classify and properly houses the banknotes 6 according to the classifying condition in the corresponding depositories 43*a* to 43*e*. Furthermore, the controller 16 is able to control each of the depositories 43*a* to 43*e* to convey the banknotes 6 at a conveying speed suitable for the condition according to which the banknotes 6 to be housed in the depositories 43*a* to 43*e* are classified.

For this reason, it is possible to increase the speed of processing on the banknotes 6 over the banknote handling machine 4.

In the first to the third embodiments, all the depositories are used to house the banknotes 6 classified according to the classifying condition; however, the depositories are not limited to such a configuration. For example, a configuration may be employed in which, when at least one of the multiple depositories is used as an auxiliary depository and any one of the depositories in which the banknotes 6 are housed becomes full, the full depository is switched with the auxiliary depository and the banknotes 6 are housed in the auxiliary depository. In this configuration, the controller drives and controls the conveying unit and the depositories to convey the banknotes to the auxiliary depository according to the result of the sensing by the capacity sensor that senses that the depository becomes full.

According to a mode of the paper sheet handling machine disclosed herein, it is possible to house multiple types of paper sheets in depositories properly.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A paper sheet handling machine comprising:

a distinguishing unit that distinguishes a given classifying condition covering the type according to which paper sheets from multiple types of paper sheets that are put in are classified;

a plurality of depositories in corresponding ones of which the paper sheets whose type is distinguished by the distinguishing unit, are classified and housed, according to the classifying condition before a transaction relating to the put-in paper sheets is determined;

a plurality of housing units in corresponding ones of which the paper sheets that are sent from the corresponding depositories, are classified and housed, according to the classifying condition after the transaction is determined; and a controller that controls the depositories according to the classifying condition, and wherein the plurality of depositories include a conveying mechanism that conveys the paper sheets and that conveys the paper sheets at different conveying speeds according to the classifying condition.

2. The paper sheet handling machine according to claim 1, wherein the controller classifies and houses the paper sheets in the depositories according to the type.

3. The paper sheet handling machine according to claim 1, wherein the controller classifies and houses the paper sheets in the depositories according to the damaged condition.

4. The paper sheet handling machine according to claim 1, wherein controller classifies and houses the paper sheets in the depositories according to the outer size.

5. The paper sheet handling machine according to claim 4, further comprising a returning unit that returns the paper sheets, which are housed in the depositories, when the transaction is not determined, wherein the returning unit has a space regulating member that is moved by the controller according to the outer size of the paper sheets and thus that regulates a housing space of the returning unit.

6. The paper sheet handling machine according to claim 1, further comprising a mount on which an additional depository for housing paper sheets whose type is distinguished by the distinguishing unit before the transaction is determined, is mounted.

7. The paper sheet handling machine according to claim 6, further comprising a conveying space for extending a conveying route on which the paper sheets are conveyed to the additional depository.

8. A paper sheet handling machine comprising:

a distinguishing unit that distinguishes a given classifying condition covering the type according to which paper sheets from multiple types of paper sheets that are put in are classified;

a depository in which the paper sheets whose type is distinguished by the distinguishing unit are housed before a transaction relating to the put-in paper sheets is determined;

a plurality of housing units in which the paper sheets that are sent from the depository are housed;

a mount on which an additional depository for classifying and housing the paper sheets whose type is distinguished by the distinguishing unit, before the transaction is determined, is mounted; and a controller that controls the depository and the additional depository according to the classifying condition.

9. The paper sheet handling machine according to claim 8, further comprising a conveying space for extending a conveying route on which the paper sheets are conveyed to the additional depository.

10. A paper sheet handling method comprising:

distinguishing a given classifying condition covering the type according to which paper sheets from multiple types of paper sheets that are put in are classified;

classifying and housing the paper sheets whose type is distinguished by the distinguishing according to the classifying condition in a plurality of corresponding depositories, before a transaction relating to the put-in paper sheets is determined; and allowing a conveying mechanism included in the depositories to convey the paper sheets at different conveying speeds according to the classifying condition, thereby sending the paper sheets from the depositories to a plurality of corresponding housing units and classifying and housing the paper sheets according to the classifying condition in the corresponding housing units, after the transaction is determined.

11. A paper sheet handling machine comprising:

a distinguishing unit that distinguishes a given classifying condition covering the type according to which paper sheets from multiple types of paper sheets that are put in are classified;

a plurality of depositories in corresponding ones of which the paper sheets whose type is distinguished by the distinguishing unit, are classified and housed, according to the classifying condition before a transaction relating to the put-in paper sheets is determined;

a plurality of housing units in corresponding ones of which the paper sheets that are sent from the corresponding depositories, are classified and housed, according to the classifying condition after the transaction is determined;

a controller that controls the depositories according to the classifying condition; and a mount on which an additional depository for housing paper sheets whose type is distinguished by the distinguishing unit before the transaction is determined, is mounted.

* * * * *